US005347695A

United States Patent [19]

Lopez Saiz

[11] Patent Number: 5,347,695

[45] Date of Patent: Sep. 20, 1994

[54] DEVICE FOR ANCHORING SHOE LACES WITH A QUICK TIGHTENING AND SLACKENING

[75] Inventor: Andres Lopez Saiz, Madrid, Spain

[73] Assignee: Preview Investigacion Aplicada, S.L., Madrid, Spain

[21] Appl. No.: 105,854

[22] Filed: Aug. 11, 1993

[30] Foreign Application Priority Data

Aug. 13, 1992 [ES] Spain ..... 9202553

[51] Int. Cl.[5] ..... A43C 5/00

[52] U.S. Cl. ..... 24/714.8; 24/713.9; 24/714.1

[58] Field of Search ..... 24/714.8, 714.6, 714.7, 24/714.1, 713.2, 713.6, 713.9, 712, 712.1, 439

[56] References Cited

U.S. PATENT DOCUMENTS

| | | | |
|---|---|---|---|
| 562,114 | 6/1896 | Benford | 24/713.9 |
| 786,406 | 4/1905 | Boynton | 24/714.8 |
| 887,942 | 5/1908 | Houghland | 24/714.1 |
| 914,628 | 3/1909 | Anderson | 24/714.1 |
| 1,450,918 | 7/1921 | Graff . | |
| 1,464,849 | 8/1923 | Loehr-Voight | 24/439 |
| 1,850,781 | 3/1932 | Weingarten | 24/714.8 |
| 1,995,243 | 6/1934 | Clarke . | |
| 2,012,188 | 8/1934 | French . | |
| 5,109,581 | 5/1992 | Gould | 24/714.8 |

FOREIGN PATENT DOCUMENTS

| | | |
|---|---|---|
| 264887 | 8/1912 | Fed. Rep. of Germany . |
| 3603411 | 8/1987 | Fed. Rep. of Germany . |

*Primary Examiner*—Victor N. Sakran
*Attorney, Agent, or Firm*—McGlew & Tuttle

[57] ABSTRACT

A device for independently connecting a plurality of eyelets together by lacing with a lace. The device has a plate with a hook for hooking and unhooking the plate from one of the eyelets. A flap is connected to the plate and one end of the flap extends beyond the hook and the plate, to form a handle allowing a user to grip the device, and then hook and unhook the hook from the eyelet. Another end of the flap is connected to a ring which defines an opening through which the lace can pass. In this way the lace can be connected and disconnected from the eyelet without having to thread and unthread the lace from the eyelet.

6 Claims, 2 Drawing Sheets

A-B

DEVICE FOR ANCHORING SHOE LACES WITH A QUICK TIGHTENING AND SLACKENING

BACKGROUND OF THE INVENTION

This specification refers to a Model of Utility related to an improved device for anchoring shoe laces with quick tightening and slackening, the evident purpose of which is allow to determine the tightening of shoes in a quick and effective way, so that once the appropriate tightening of a shoe has been made by using a knot or bow with the lace in a conventional manner, to carry out later the necessary successive tightening and slackening operations, the user's task is simply to only and exclusively hook and unhook the relative anchorages.

1. Field of the Invention

This invention applies to the industry field devoted to manufacture auxiliary elements for shoes.

2. Description of the Invention

The improved device for anchoring shoe laces with quick tightening and slackening as proposed by the invention constitutes per se an evident solution to the present problems on this matter.

In a more definite manner, the improved device for anchoring shoe laces with quick tightening and slackening which is the object of the present invention is constituted as an element which is capable of providing the shoes with a quick tightening of same, this tightening to the foot being maintained in an invariable way, even when the shoe has been put on and removed several times.

In synthesis, the device is constituted from a plate having a hook configuration, which is destined to carry out a hooking and unhooking at the eyelet located on a shoe, having a fastening sheath made of a plate, and a flap-shaped ring, the function of which is to make easy the handle and use of same.

At the same time, the device has a ring or link which is formed on the flap and serving as an eyelet, through which the shoe lace is inserted, so being converted into a new pass therefore.

This device can be incorporated in a conventional footwear, and it constitutes a link of very ample use.

BRIEF DESCRIPTION OF THE DRAWINGS

To complement this description and in order to aid to a better understanding of the features of the invention, the accompanying drawings, which are a part of this specification, show in an illustrative but non limitative manner, the following.

DETAILED DESCRIPTION OF THE PREFERRED EMBODIMENTS

Figure 1:
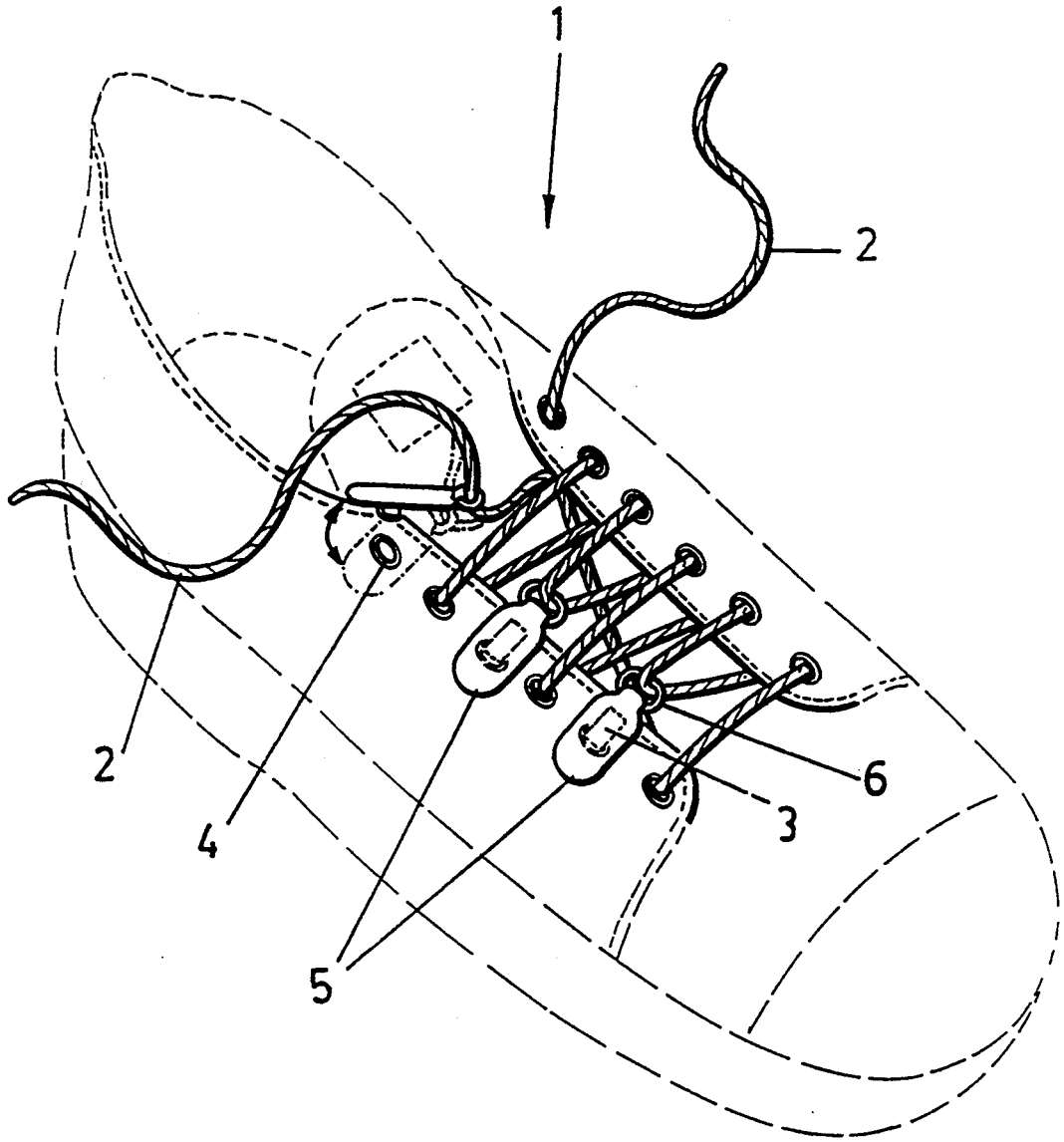
FIG. 1 shows a perspective view of a conventional shoe, in which the improved device for anchoring shoe laces with quick tightening and slackening of the invention has been incorporated.
Figure 2:
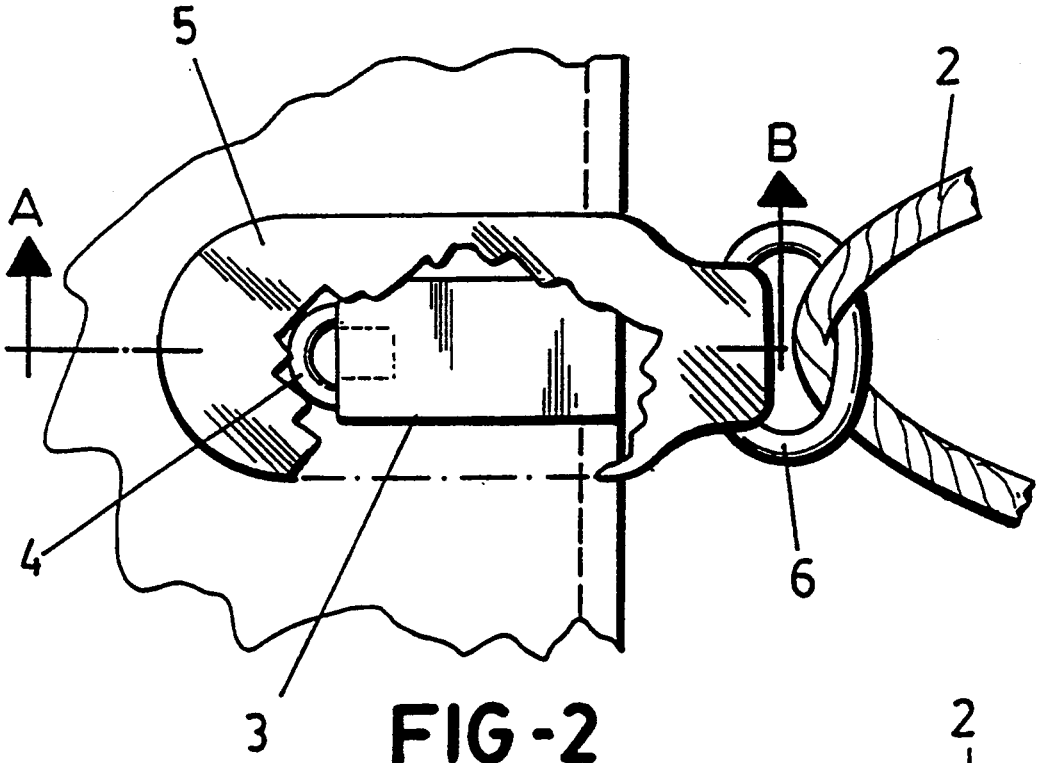
FIG. 2 shows a plan view of the device in question.
Figure 3:
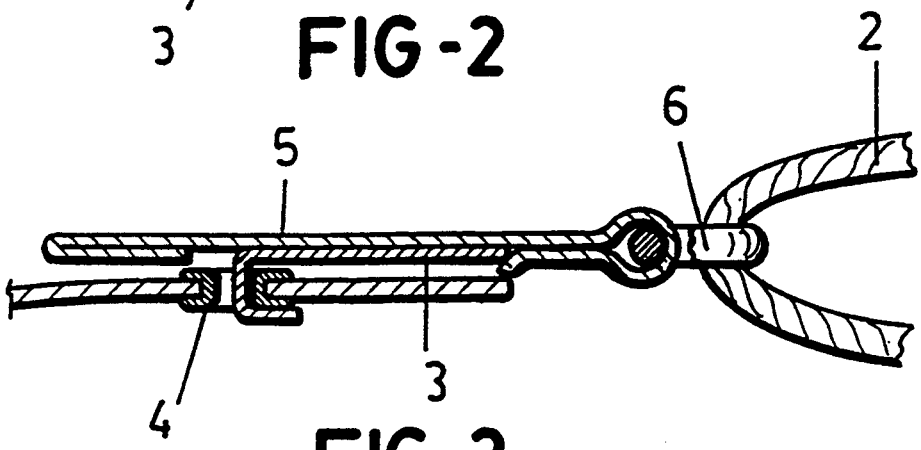
FIG. 3 shows a side elevational view, duly sectioned, of the object shown in FIG. 2.

From these Figures, it can be noted how the improved device for anchoring shoe laces with quick tightening and slackening is constituted from a conventional shoe (1), which is provided with conventional laces (2), the surface of this shoe having a hook-shaped plate (3) the function of which is to facilitate the hooking and unhooking in the eyelet (4) located on the shoe (1).

Also, the device has a fastening sheath made on plate and a flap or flap-shaped ring (5) to make easy the handling and use.

Lastly, it must be pointed out that the device has a ring or link (6) the function of which is to serve as an eyelet, which is destined to allow the shoe lace (2) to be inserted into it, so being converted into a new pass for same.

It is not considered to extend more this description for an expert in the art to understand the scope of the invention and the advantages derived from it.

The materials, shape, size and arrangement of the components will be open to variation, provided that it does not imply any alteration to the essence of the invention.

The terms under which this specification has been described should be always taken in an ample and non limitative sense.

I claim:

1. A device for independently connecting a plurality of eyelets together by lacing with a lace, the device comprising:

a plate having a first end and a second end;

a hook means attached to said plate and for hooking and unhooking said plate from one of the plurality of eyelets;

a flap connected to said plate, said flap having a first portion extending from a first side of said plate and a second portion extending from a second side of said plate, said first portion of said flap forming a handle means for using said hook means to hook and unhook said plate from the one of the plurality of eyelets;

a ring connected to said second portion of said flap, said ring defining an opening through which the lace can pass.

2. A device in accordance with claim 1, wherein:

said first portion and said handle means of said flap is on an opposite side of said plate than said second portion and extends beyond said hook means.

3. A device in accordance with claim 1, wherein:

said hook means includes a hook bent in a direction of said ring.

4. A device in accordance with claim 3, wherein:

said direction of said bend of said hook is also in a direction toward the lace and other of the plurality of eyelets.

5. A device in accordance with claim 1, wherein:

the plurality of eyelets and lace are part of a shoe, where the shoe can be quickly tightened and slackened by hooking and unhooking said hook means from the one eyelet.

6. A device in accordance with claim 1, wherein:

said second portion of said flap is passed through said ring and then folded over on and attached to itself.

* * * * *